US006520770B2

(12) United States Patent
Zou

(10) Patent No.: US 6,520,770 B2
(45) Date of Patent: Feb. 18, 2003

(54) PRAYER CANDLE DEVICE

(76) Inventor: Cindy Zou, 2331 Finlandia La., Apt. 81, Clearwater, FL (US) 33763

( * ) Notice: Subject to any disclaimer, the term of this patent is extended or adjusted under 35 U.S.C. 154(b) by 0 days.

(21) Appl. No.: 09/873,603

(22) Filed: Jun. 4, 2001

(65) Prior Publication Data

US 2001/0029003 A1 Oct. 11, 2001

Related U.S. Application Data

(63) Continuation-in-part of application No. 09/535,721, filed on Mar. 27, 2000, now Pat. No. 6,267,584.

(51) Int. Cl.[7] ..... F21V 35/00
(52) U.S. Cl. ..... 431/290; 431/291; 362/228
(58) Field of Search ..... 431/126, 288, 431/289, 290, 291; 44/275; 362/161, 228, 392, 569, 808, 810; D26/9, 16, 22, 23

(56) References Cited

U.S. PATENT DOCUMENTS 3,604,825 A * 9/1971 Leshko ..... 431/290
3,762,857 A * 10/1973 Andeweg ..... 431/289
4,680,683 A * 7/1987 Schenke et al. ..... 431/290
4,866,580 A * 9/1989 Blackerby ..... 362/810
6,267,584 B1 * 7/2001 Zou ..... 431/290
6,273,710 B1 * 8/2001 Zou ..... 431/290

FOREIGN PATENT DOCUMENTS

GB 2230888 A * 10/1990 ..... 40/547

* cited by examiner

*Primary Examiner*—Sara Clarke
(74) *Attorney, Agent, or Firm*—John Lezdey

(57) ABSTRACT

The invention provides a candle holding device, which has an outer tubular member and an inner tubular member mounted on a base. The inner tubular member houses a light-emitting element such as a candle. The base of the candle holding device has light emitting elements such as LEDs and sound recording and/or producing devices, which are connected to a power source.

10 Claims, 2 Drawing Sheets

PRAYER CANDLE DEVICE

RELATED APPLICATIONS

This application is a continuation-in-part of application Ser. No. 09/535,721, filed Mar. 27, 2000, U.S. Pat. No. 6,267,584.

FIELD OF THE INVENTION

The present invention relates to prayer and holiday candle devices and more particularly to a prayer candle device, which can provide a good atmosphere and decorative function. There is also provided a candle device with light and/or sound.

DESCRIPTION OF RELATED ARTS

Historically, people use candles at home, church, or other places of worship to provide an atmospheric or decorative touch. In order to hold the candle in place, a candle container is used to prevent the candle from accidentally falling out and starting a fire. The conventional candle container comprises a hollow cylindrical body having a candle cavity therein, so that a candle can be inserted into the candle cavity. A spring is also inserted in the candle cavity so as to normally urge the candle upwardly to maintain a burning end thereof at an upper position.

However, after the burning end of the candle inside the candle container is ignited, the consumable material, such as wax, of the candle starts melting. The melted consumable material will flow back into the candle container, such that when the consumable material is condensed inside the candle cavity, the rest of the unburned candle may stick inside the candle container and it is hard to clean up. Some melted candle materials may flow out of the candle container and stick on the outer surface thereof. Accordingly, the melted candle material not only destroys the beauty of the candle container but also damages the decoration surface of the candle container.

Some improved candle containers comprise a drain opening such that when the candle material flows into the interior of the candle container, a user is capable of flushing the accumulated candle material through the drain opening. However, when the candle material is condensed at the bottom of the candle cavity where the spring is positioned, the spring may lose its elastic property while the candle material is stuck around the spring. The user may need to replace the spring as well or flush all the candle material several times within lighting one candle. So, the conventional candle container has some drawbacks on usage under certain circumstances.

SUMMARY OF THE PRESENT INVENTION

A main object of the present invention is to provide a prayer or holiday candle device, which can provide a good atmosphere and decorative function.

Another object of the present invention is to provide a prayer or holiday candle device, which is adapted for operating by a regular consumable candle with wick.

Another object of the present invention is to provide a prayer or holiday candle wherein the melted candle material may flow into a collecting chamber in order to prevent the malfunction of the operation.

A further object of the invention is to provide a prayer or holiday candle device having sound and/or light effects.

Accordingly, in order to accomplish the above objects, the present invention provides a prayer or holiday candle device, which comprises:

an outer tubular body having a chamber therein, an open end defining a supporting rim and a base at the bottom;

an inner tubular body within said outer tubular body mounted on said base;

a lighting element having a light emitting portion mounted in said inner tubular body;

means for generating or recording sound and light mounted in base of said tubular body; and a cover, which is fittedly disposed on the supporting rim of the tubular body, having a hole provided thereon, wherein the light emitting portion of the lighting element is adapted to protrude through the hole to the outside.

It is understood that the term lighting element is meant to include candle, gel, votive or the like and the terms are interchangeable, or a tubular body having a light bulb or an LED.

The objects and advantages of the present invention will be better understood by a reading of the description of preferred embodiments together with the drawings.

DESCRIPTION OF THE PREFERRED EMBODIMENTS

Figure 1:
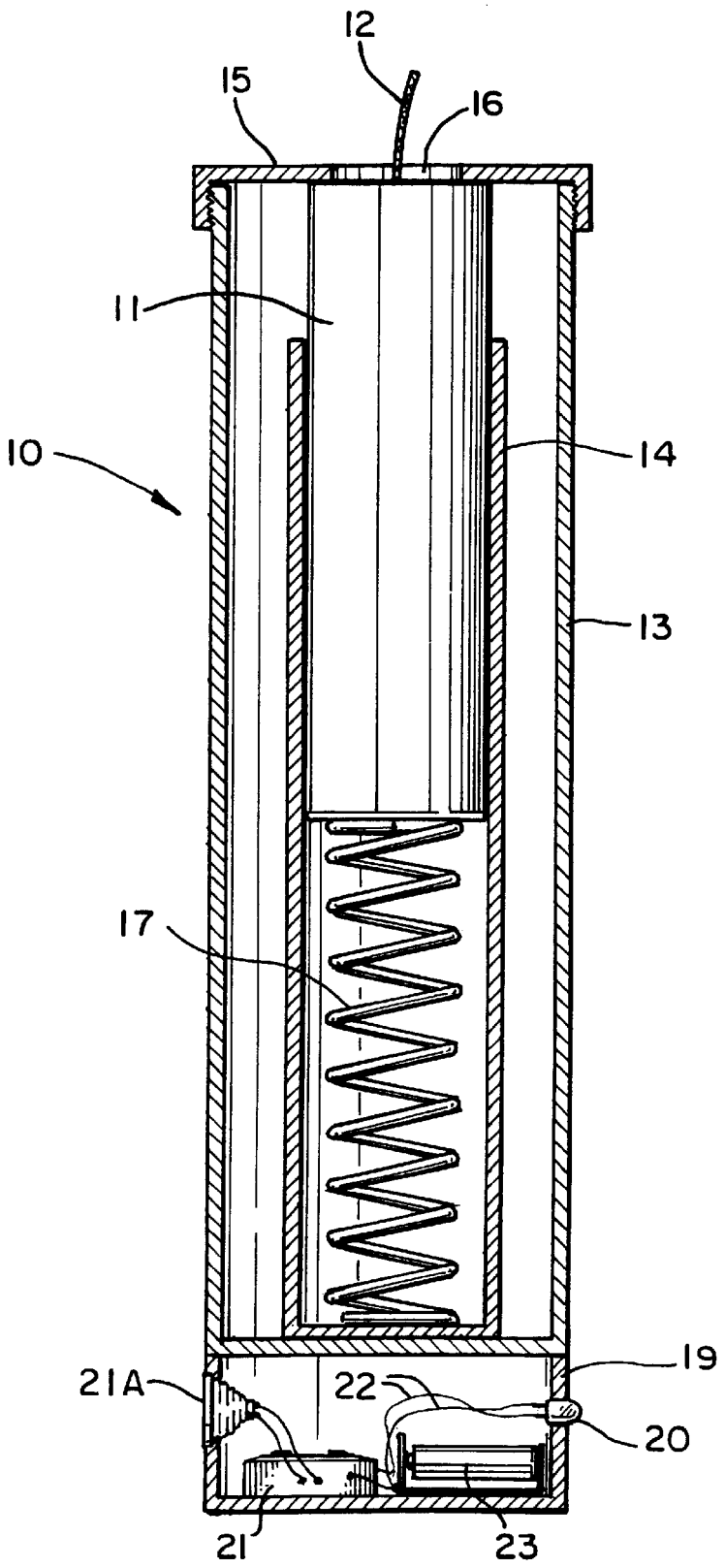
FIG. 1 is a sectional view of a candle device according to a first preferred embodiment of the present invention with light and sound.

Referring to FIG. 1 of the drawings, a candle device 10 according to a first preferred embodiment of the present invention is illustrated, which comprises an outer tubular body 13, an inner tubular body 14 housing a consumable lighting element such as a candle 11, having a wick 12 and a compression spring 17 for raising said candle 11 as it becomes consumed. The candle 11 can be a wax candle, gel candle, or votive candle.

The tubular body 13 has an open end defining a supporting rim on which the cover 15 sits with opening 16 and a base 19 for stabilizing the prayer candle device 10. The consumable lighting element 11 is refillably disposed in the chamber of the tubular body 11.

As shown in FIG. 1, a candle device 10 of the invention can be provided with a base 19, which houses a sound recording device 21 with a speaker 21A or receiver. The sound recording device may have prerecorded sounds or record sounds.

Additionally, there is provided a lighting element such as a light bulb or LED 20, which can illuminate the inside of the candle device or the outside. A battery 23 can be associated to provide power to the sound device 21 and to power the lighting elements 20, which are preferably LEDs.

The lighting elements 20 comprise a plurality of lighting elements such as light bulbs or LEDs encirclingly and evenly mounted on the base, a power supply, such as a rechargeable battery 23 for providing electrical power to the lighting elements mounted at the bottom of the base 19, and a plurality of connecting wires 22 connected between the power supply and the lighting elements 20 respectively. So, when the candle 11 is not in use or is used up, the lighting elements 20 can substitute for the candle in order to light up the candle device 10. Moreover, the lighting elements 20 can further provide an esthetically pleasing appearance and decorative touch to the prayer candle device of the present invention.

Additionally, the candle device 10 as shown in FIG. 1, comprises a sound generating means which comprises a tape recorder installed at the bottom of the base and at least a speaker 1A for outputting sound signal affixed on an outer surface of the base 19. The power supply 23 is mounted at the bottom of the base 19 near the tape recorder and the connecting wires for electrically connecting between the tape recorder, the speaker and the power supply 23 by means of a closed circuit such that the sound generating means is adapted for generating sound such as songs and praying messages from a pre-recorded tape, or to record a message or music.

Figure 2:
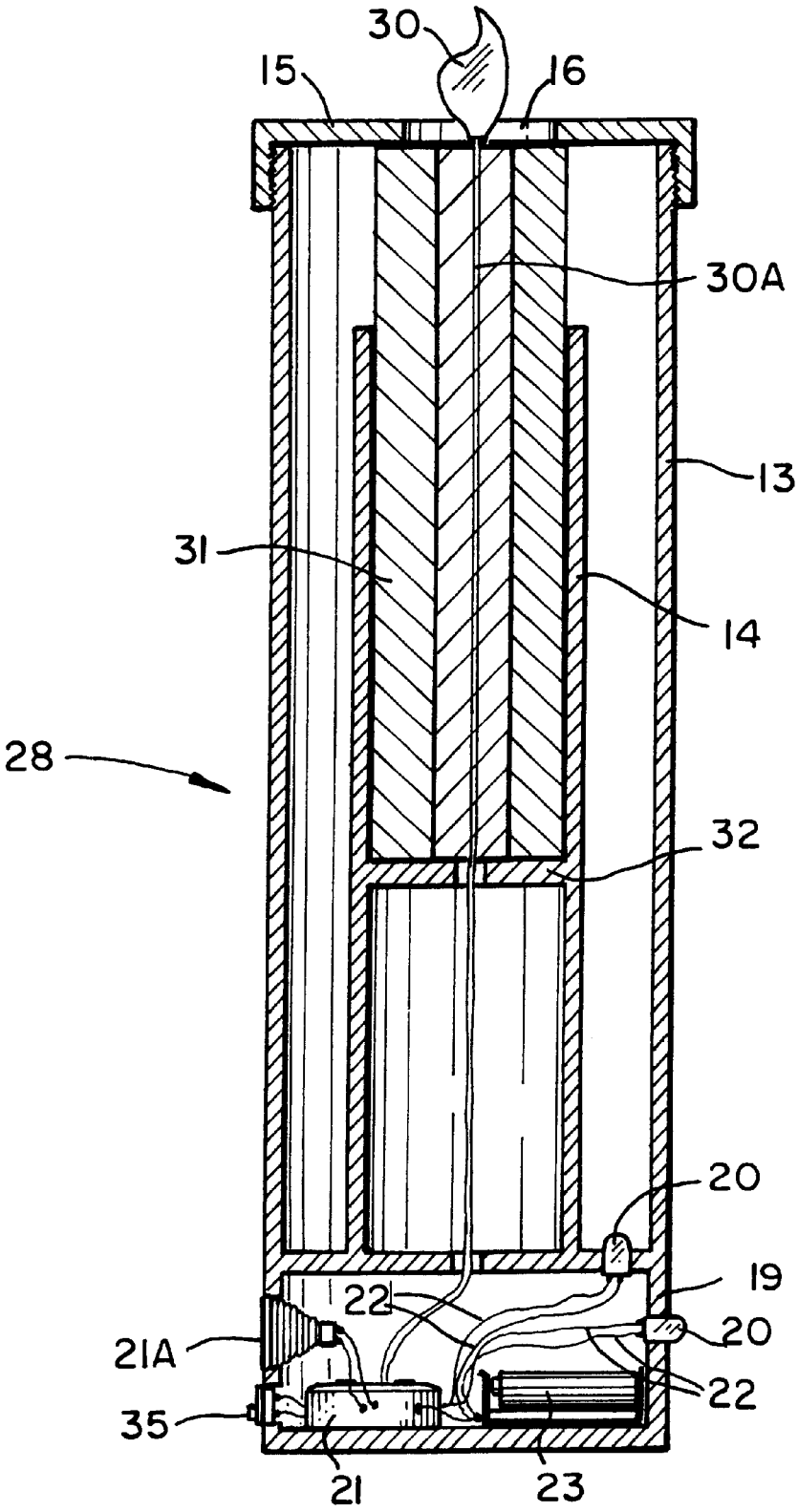
FIG. 2 is a sectional view of the candle device of the invention with sound and light elements wherein the lighting element is an LED.

FIG. 2 illustrates a further embodiment of the invention wherein candle device 28 is provided with a base 19 and an inner tubular body 14 having a lighting element 31 stationary mounted therein. The lighting element may be a candle or tubular member having a light bulb or LED 30 simulating a lit candle. Similar to the device of FIG. 1, the base 19 contains the sound means 21 with speaker 21A, LEDs 20 and a bettery 23.

The base 19 may be provided with control buttons for controlling the various activities. For example, button 35 can be an ON and OFF button which controls the power supply or recording.

Preferably, the outer tubular member 13 and the inner tubular member 14 are made of transparent material such as crystal or glass so that the light can be reflected through the tubular body 13 for providing an esthetically pleasing appearance. Furthermore, a three-dimensional figure of decorations such as angels, flowers, "JESUS CHRIST", a "POPE", "JOHN PAUL", "SANTA CLAUS", or the like can be attached inside and/or formed on the inner or outer surface of the tubular body for further providing an atmospheric or decorative touch as disclosed in co-pending application Ser. No. 09/846,953 entitled Prayer Candle Device filed May 1, 2001, which is herein incorporated by reference.

When the light generating element 30 is a LED or a light bulb, the lighting element may be mounted on a platform 32 through which the wiring 30A leads from the LED or bulb 30 to the power supply 23.

LEDs 20 may be mounted around the base or on the base between the inner and outer tubes.

What is claimed is:

1. A candle device, comprising:

a transparent outer tubular body having a chamber therein, an open end defining a supporting rim and a base;

a transparent inner tubular member mounted within said outer tubular body supported on said base;

a lighting element having a light emitting portion disposed in a chamber of said inner tubular member, which lights up the outer tubular body;

a cover, which is fittedly disposed on said supporting rim of said tubular body, having a through hole provided thereon, wherein said light emitting portion of said lighting element penetrates through said hole to the outside;

said base housing a sound means, a light means, and a power supply means for said sound means and light means.

2. The candle device, as recited in claim 1, wherein said power supply comprises a battery for providing electrical power to said light means and sound means, and a plurality of connecting wires each connected between said battery and said light means and sound means.

3. The candle device of claim 1 wherein said lighting element is selected from the group consisting of wax candle, gel candle and votive.

4. The candle device of claim 3 including spring means within said inner tubular member for urging said lighting element upward whereby the light emitting portion penetrates the hole in said cover.

5. The candle device of claim 1 wherein said lighting element is stationary.

6. The candle device of claim 5 wherein said lighting element has a light emitting portion comprising a light bulb.

7. The candle device of claim 5 wherein said lighting element has a light emitting portion comprising an LED.

8. A candle device, comprising:

a transparent outer tubular body having a chamber therein, an open end defining a supporting rim, and a base;

a transparent inner tubular member mounted within said outer tubular body and supported on said base;

a lighting element comprising a candle having a wick and disposed in said chamber of said inner tubular member, which lights up the inner and outer tubular members;

a cover, which is disposed on said supporting rim of said outer tubular body, having a through hole provided thereon, wherein said wick of said candle penetrates through said hole to the outside; and light means and sound generating means housed in said base.

9. The candle device of claim 8 including:

means for raising said candle so as to urge the burning end of said wick of said candle at its upper position, through said hole in the cover;

a light means and said sound generating means mounted on said base of said tubular body, and a power supply for providing electrical power to said light means and said sound generating means mounted on said base.

10. The candle device, of claim 8 wherein said sound generating means comprises a tape recorder installed at a bottom of said base, a speaker for outputting sound affixed on an outer surface of said base, a power supply mounted at said bottom of said base near to said tape recorder, and a plurality of connecting wires for electrically connecting between said tape recorder, said speaker and said power supply in a closed circuit.

* * * * *